United States Patent [19]

Managadze

[11] Patent Number: 4,611,118

[45] Date of Patent: Sep. 9, 1986

[54] TIME-OF-FLIGHT ION MASS ANALYZER

[75] Inventor: Georgy G. Managadze, Moscow, U.S.S.R.

[73] Assignee: Institut Kosmicheskish Issledovany Akademi Nauk SSS, Moscow, U.S.S.R.

[21] Appl. No.: 631,850

[22] Filed: Jul. 18, 1984

[30] Foreign Application Priority Data

Aug. 16, 1983 [SU] U.S.S.R. ..... 3641102
Feb. 16, 1984 [SU] U.S.S.R. ..... 3702216

[51] Int. Cl.[4] ..... H01J 49/40
[52] U.S. Cl. ..... 250/287; 250/281
[58] Field of Search ..... 250/281, 282, 286, 287, 250/288, 399, 294

[56] References Cited

U.S. PATENT DOCUMENTS 3,727,047 4/1973 Janes ..... 250/287
3,955,084 5/1976 Giffin ..... 250/281
4,072,862 2/1978 Mamyrin et al. ..... 250/287

FOREIGN PATENT DOCUMENTS 198034 6/1967 U.S.S.R. ..... 250/281
0591107 8/1982 U.S.S.R. ..... 250/281

OTHER PUBLICATIONS

Gloecker et al., Time of Flight Technique for Particle Identification at Energies from 2-400 keV/Nucleon, Nuclear Inst. and Meth., vol. 165, No. 3, (1979).

Challenge Comet Halley Neutral Gas Experiment, Proposal Submitted to ESA in Response of Giotta Call for Experiment Proposals, 1980.

*Primary Examiner*—Bruce C. Anderson
*Assistant Examiner*—Paul A. Guss
*Attorney, Agent, or Firm*—Lilling & Greenspan

[57] ABSTRACT

A time-of-flight ion mass analyzer comprises a device for preacceleration of ions being analyzed and a sensing member of the analyzer detecting the moment at which an ion enters a time-of-flight space, a reflector and an electron detector connected to a time interval measurement device, which are provided in series downstream the preacceleration device. The reflector has at least two grid electrodes: an intermediate electrode and a bottom electrode. The intermediate electrode is designed to receive a potential which creates, in the reflector space, two zones divided in accordance with electric field steepness, and a difference of potentials between the bottom electrode of the reflector and the sensing member of the analyzer is chosen in the absolute value such as to be greater than, or equal to, the potential difference at the preacceleration device.

5 Claims, 5 Drawing Figures

TIME-OF-FLIGHT ION MASS ANALYZER

BACKGROUND OF THE INVENTION

1. Field of the Invention

The invention relates to engineering instrumentation, and more particularly it relates to time-of-flight ion mass analyzers designed for the determination of mass and isotope composition of substances used in solving general problems of chemical analysis, and more particularly for the determination of mass and isotope composition of plasma in vacuum.

2. Description of the Prior Art

Known in the art is a time-of-flight ion mass analyzer or a mass reflectron in which ions of a studied substance which are formed by a focused laser radiation or under the action of an electron beam are reflected from a reflector during their flying asunder or after preacceleration and are recorded by a detector. The initial energy of ions once ionized and the flight time being known, the ion mass can be determined. A space-time focusing of ion packets, diffusing because of a spread in the initial energy, is effected in the reflectron so that the instrument has high mass resolution (up to 3000) (cf. B.A. Mamyrin, Mass Reflectron, Jr. of Experimental and Theoretical Physics (in Russian), v. 64, No. 1, 1973).

The known instrument cannot, however, be used for the determination of ion mass if one does not know exactly the starting time so that the instrument cannot be used without its own ion source which is to inject ions into the instrument (generally during a time of a maximum 1 to 10 ns). Therefore, the above described instrument cannot be used as a mass analyzer of ion beams incoming from the outside.

Known in the art is a time-of-flight ion mass analyzer comprising a device for preacceleration of ions being studied, a sensing member of an analyzer used to detect the moment at which an ion enters the time-of-flight space (in the form of carbon foil) and an electron detector connected to a time interval measurement device, which are located in series downstream the preacceleration device (cf. "Comet Halley Neutral Gas Experiment—CHALLENGE", Proposal Submitted to ESA in Response of Giotto. Call for Experiment Proposals. Pr. SCI (80)7. Max-Planck Institut für Aeronomie, Lindau, 1980).

In the prior art mass analyzer the mass analysis of individual ions coming from the outside is effected in accordance with their time-of-flight through a pre-set portion of the instrument, i.e. through the time-of-flight space, provided the particles have a low spread of energy and a low initial energy. Generally such ions are accelerated in the preacceleration device of the instrument to an energy of 45 to 70 keV and are then caused to pass through a thin carbon foil (about 2 $\mu g/cm^2$). Secondary electrons emitted from the foil, which are recorded by means of a detector in the form of a system of microchannel plates (MCP) serve as a starting signal for counting the time of ion movement through the time-of-flight space of a pre-set length. A similar MCP system at the end of the time-of-flight space is used to measure the ion arrival time and generates a STOP signal. Given the initial ion energy and their flight time, one can determine the mass of singly charged ions.

The prior art mass analyzer is, however, deficient in low mass resolution in recording heavy ions. This is due to the fact that with an increase in the ion mass the effective spread in energy losses during ion movement through the foil becomes higher. For this reason it is necessary to have high preacceleration voltage in the receiving part of the instrument.

Nevertheless, in accordance with the reference, with a preacceleration voltage in the instrument of about 75 kV for masses of about 100 amu the mass resolution $M/\Delta M$ is as low as 10 ($M/\Delta M$ is about 40 for M of about 40 amu) so that mass peaks of isotopes of medium and heavy substances cannot be resolved. The provision of a preacceleration system operating at high voltage in the instrument restricts the field of its application, substantially lowers its reliabiity because of liability to high-voltage breakthrough, and the instrument's structure is complex and heavy.

SUMMARY OF THE INVENTION

The invention is based on the problem of providing a time-of-flight ion mass analyzer which has a member capable of making up for a spread in energy losses of ions and improving the efficiency of recording ions when they deviate from the initial path upon passing through foil, whereby high accuracy of mass and isotope analysis of ions coming from outside and having considerable spread in energy and relatively high initial energy becomes possible with high mass resolution in recording heavy ions, weight reduction; improvement of reliability and simplification of structure is obtained due to the lowering of high voltage.

This problem is solved in a time-of-flight ion mass analyzer having a device for preacceleration of ions being studied, a sensing member of an analyzer detecting the moment at which an ion enters a time-of-flight space and an electron detector connected to a time interval measurement device, both of which are located in series downstream from the preacceleration device. According to the invention, a reflector is installed between the sensing member of the analyzer and the electron detector, the reflector comprising at least two grid electrodes—an intermediate electrode and a bottom electrode. The electrode located closest to the sensing member of the analyzer (the intermediate electrode) is designed for receiving a potential creating within the reflector space two zones in accordance with field steepness, the potential difference between the bottom electrode of the reflector and the sensing member of the analyzer being chosen to be equal to or greater in absolute value than the potential difference across the preacceleration device.

In order to prevent a reflected ion from travelling back to the preacceleration device, the plane of the intermediate electrode preferably extends at an angle $\alpha$ with respect to the ion acceleration direction, and the zone of the reflector between the sensing member of the analyzer and the intermediate electrode is made in the form of two identical channels—a channel for preliminary acceleration of electrons and a channel for ion outlet. The axes of the channels intersect each other at an angle of 2 $(\pi-\alpha)$, and an auxiliary ion detector is installed at the outlet of the ion outlet channel.

The time-of-flight ion mass analyzer is preferably provided with an energy filter disposed upstream the inlet of the preacceleration device and having its input connected to the output of a pulse voltage unit which is controlled by signals coming from the output of the time interval measurement device.

The sensing member of the analyzer detecting the moment at which an ion enters the time-of-flight space is preferably made in the form of a louver having its fins installed at a maximum angle of 10° with respect to the ion acceleration direction, the width of the fins being sufficient to shut-off the incident ion flow.

The sensing member of the analyzer detecting the moment at which an ion enters the time-of-flight space may also comprise a microchannel plate in which the angle of inclination of channel axes to the plate bases does not exceed 10°, the plate thickness being sufficient to shut-off the incident ion flow.

The time-of-flight ion mass analyzer according to the invention makes it possible to obtain a 5 to 7-fold reduction of the preacceleration voltage compared to the prior art foil mass analyzer, while at the same time providing for an increase of the mass resolution by several times with a given foil thickness resulting in a 3-10 times increase in the efficiency of an ion recording (with the admissible spread in ion energy being 10 to 20%). The apparatus is simple in structure and its size is comparable or smaller than instruments used for similar purposes. The provision of a reflector in the time-of-flight ion mass analyzer according to the invention with more than two grid electrodes makes it possible to work with an admissible spread in ion energy with a high mass resolution increased several times.

BRIEF DESCRIPTION OF THE DRAWINGS

The invention will now be described with reference to specific embodiments thereof illustrated in the accompanying drawings, in which.

DETAILED DESCRIPTION OF THE INVENTION

Figures 1, 2:
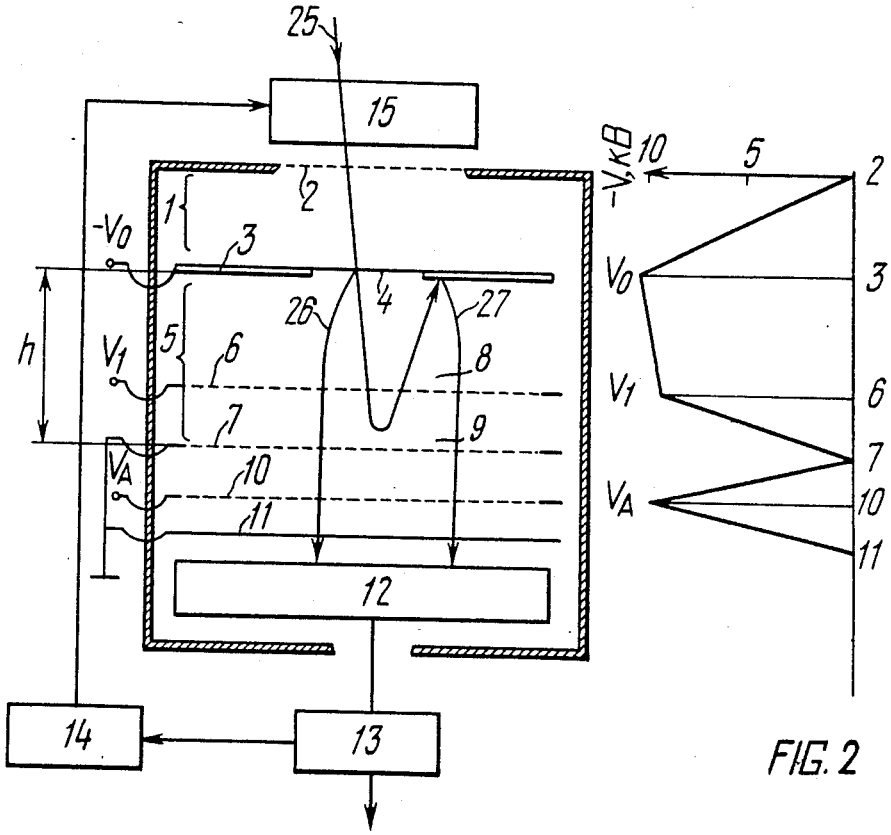
FIG.1 is a schematic illustration of a time-of-flight ion mass analyzer.
FIG. 2 is a diagram of voltage potentials at the electrodes of the mass analyzer shown.

A time-of-flight ion mass analyzer shown in FIG. 1 has an ion preacceleration device 1 consisting of two tandem-mounted electrodes 2 and 3 of which the electrode 2 is a grid electrode and the electrode 3 is made of a metal plate which is externally coated with a substance having a high ion and electron secondary emission coefficient, such as nickel film. In the central zone of the electrode 3 is a sensing member 4 of an analyzer detecting the moment at which an ion enters the time-of-flight space, which comprises a carbon foil of 20 to 100 Å thick. Downstream the preacceleration device 1 and the sensing member 4 is installed a reflector 5, which in this embodiment of the instrument consists of two grid electrodes 6 and 7, which are respectively an intermediate electrode and a bottom electrode. The intermediate electrode 6 is positioned closest to the sensing member 4 and is designed for applying thereto a potential which creates in the space of the reflector 5 two zones 8 and 9 divided in accordance with the electric field steepness. A preliminary acceleration of secondary electrons takes place within zone 8 and the main deceleration of ions occurs within the portion 9. The space defined by the electrode 3 on one side and the bottom electrode 7 on the other side is the time-of-flight space h. An analyzing grid 10, protective foil 11 and an electron detector 12 are installed in series downstream the bottom electrode 7. The electron detector 12 is connected to the input of a time interval measurement device 13 having its output connected to the input of a pulse voltage unit 14. The time-of-flight ion mass analyzer also comprises an energy filter 15 which is installed upstream the inlet of the preacceleration device 1 and has its input connected to the output of the pulse voltage unit 14. All grid electrodes 2,6,7 and the analyzing grid 10 are in the form of grids having a high barrier factor (95–98%) and a low secondary electron emission coefficient. The detector 12 in this embodiment is in the form of an assembly of two tandem-mounted microchannel plates. The energy filter 15 may comprise, for example an electrostatic deflection system which is capable of attenuating the initial particle flow by three to four orders upon feeding a pre-set voltage thereto. The pulse voltage unit 14 may be built around any oscillator generating narrow single square pulses (of about 0.01 to 3 μs).

The above embodiment of the ion mass analyzer comprises only two grid electrodes 6 and 7 in the reflector 5. It is understood that the number of such electrodes may be increased in order to provide for a more complicated non-linear distribution of potential lengthwise along the reflector 5. This will provide for an improvement of the physical characteristics of the instrument as regards the possibility of recording, at high mass resolution, ions having a substantial spread in initial energy.

FIG. 2 shows a diagram of voltages at the electrodes of the mass analyzer, wherein voltages V and kV are plotted on the ordinates and the numbers of respective electrodes of the mass analyzer are plotted on the abscissae. The coordinate axes in FIG. 2 are turned at 90° for linking the points in the diagram with corresponding electrodes of the mass analyzer in FIG. 1.

Figure 3:
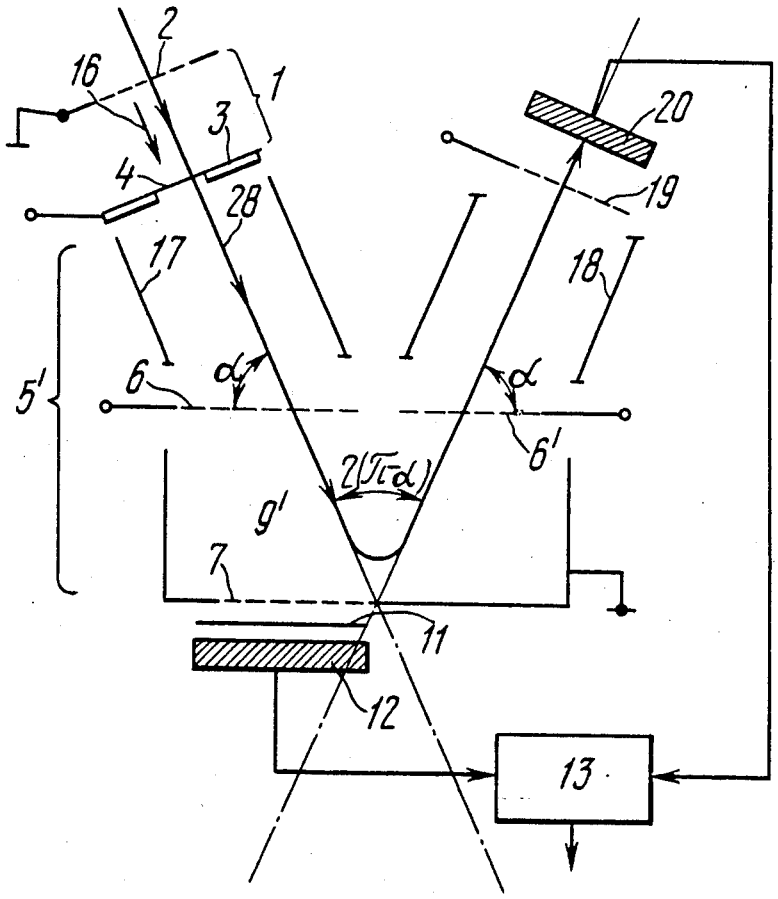
FIG. 3 is a schematic illustration of a second embodiment of a time-of-flight ion mass analyzer having a two-channel reflector.

The embodiment of the time-of-flight ion mass analyzer shown in FIG. 3 differs from the embodiment shown in FIG. 1 in that the plane of the intermediate electrode 6 extends at an angle $\alpha$ with respect to the direction 16 of ion acceleration and in that the zone of the reflector 5' between the sensing member 4 and the intermediate electrode 6 comprises two similar channels 17 and 18 having their axes intersecting each other at an angle of 2 $(\pi-\alpha)$. The channel 17 is a channel of preliminary acceleration of electrons and the channel 18 is an ion outlet channel. At the inlet of the latter is installed a grid electrode 6', similar to the electrode 6, and at the outlet a grid electrode 19, similar to the electrode 3, and a detector 20 similar to the detector 12 is installed downstream thereof. A zone 9' of the reflector 5' between the intermediate electrode 6 and the bottom electrode 7 is a zone of complete deceleration and reflection of ions. The detectors 12 and 20 are connected to the inputs of the time interval measurement device 13, a signal START being received from the detector 12 and a signal STOP being received from the detector 20.

One of the most critical and labour-consuming elements of the instrument is the sensing member 4 of the analyzer which detects the moment at which an ion enters the time-of-flight space and which comprises a thin carbon foil. The moment of ion entry is determined by recording a secondary electron emitted by the ion when it is passing through the foil. The small thickness of foil which is necessary for mass resolution makes this element of the instrument the most vulnerable.

Figure 4:
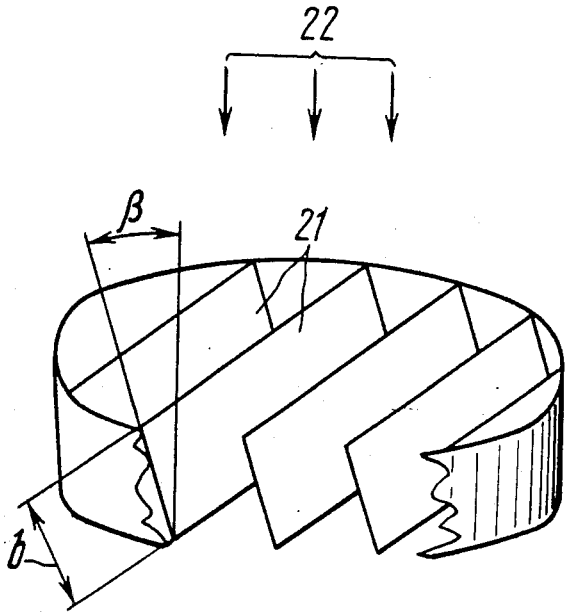
FIG. 4 is a perspective view of an analyzer, showing an ion the moment it enters the time-of-flight space.

The design of the sensing member shown in FIG. 4 is more reliable.

This embodiment of the sensing member comprises a louver having its fins in the form of plates 21 inclined at an angle $\beta$ that to the vertical (in the drawing) does not exceed 10°; the width b of the fins 21 being sufficient to shut-off the primary acceleration ion flow 22 which is incident in the vertical direction. The louver fins 21 are made in such a manner as to provide for a low ion-to-ion emission from a material with a large atomic number such as W or Mo; as an alternative the fins 21 may be coated with the same material.

Figure 5:
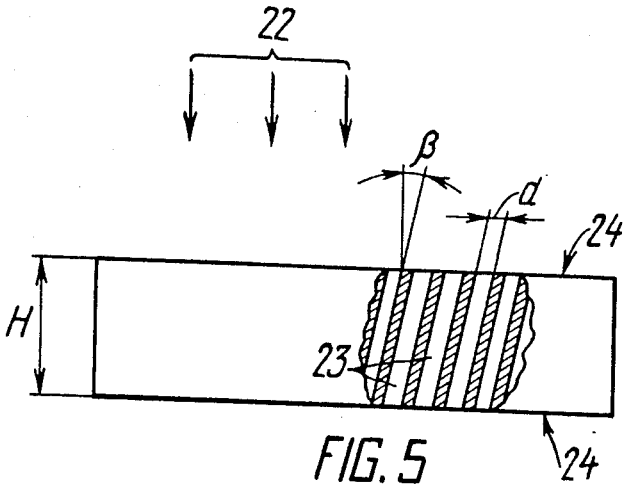
FIG. 5 is a front plan view in partial section, of the sensing member, in the form of a multichannel plate showing an ion the moment it enters the time-of-flight space.

The sensing member of the analyzer detecting the moment at which an ion enters the time-of-flight space, according to the invention, may be in the form of a microchannel plate shown in FIG. 5 and having an angle $\beta$ of inclination of the axes of its channels 23 to the plate bases 24 not exceeding 10°. The plate thickness H is such as to ensure shutting-off of the preliminary acceleration ion flow 22 incident thereupon with a given diameter d of the channels 23.

The time-of-flight ion mass analyzer according to the invention functions in the following manner.

The following voltages are applied to the electrodes of the instrument: the casing has the ground potential (zero), the electrode 2 (FIGS. 1,2) is under the casing potential, a negative potential $V_o$ relative to the casing is applied to the electrode 3 and respectively to the sensing member 4 of the analyzer (for a simple case of low-energy ions this is $-10$ kV). The intermediate electrode 6 is under the potential of $V_1 \approx 0.9\ V_o$, the bottom electrode 7 is generally under the casing potential (or a low potential $+0.1\ V_o$ with respect to the casing). The potential difference $V_o$ applied to the preacceleration unit 1 is lower than, or equal to, the potential difference $V_R$ at the reflector 5 between the electrodes 3 and 7: $|V_o| \leqq \leqq |V_R|$ in the absolute value. The analyzing grid 10 is under the potential $V_A$, $V_o < V_A < V_1$ and the protective foil 11 is under the zero potential. In this embodiment the reflector 5 has only two zones 8 and 9 separated by the intermediate electrode 6, which differ in steepness of electric field. In another embodiment, of a multiple grid reflector, the field of a multiple grid reflector the field between the electrode 3 and 7 may be non-linear or it may consist of a plurality of linear field zones.

In the attendance duty, the energy filter 15 is open for the passage of ions. An ion, the trajectory of which is shown with a curve 25 in FIG. 1, flies freely through the filter 15 to get into the preacceleration unit 1 where it is accelerated to an energy corresponding to the voltage $V_o$. Having broken through the foil (the sensing member 4 of the analyzer detecting the moment at which the ion enters the time-of-flight space) and lost thereby a part of its initial energy, the ion generates a first group of secondary electrons (the trajectory of which is shown with a line 26 in FIG. 1) and starts decelerating in the field of the reflector 5. Secondary electrons pass through the acceleration zones in the field of the reflector 5, analyzing grid 10 and foil 11, then enter the detector 12. A pulse recording these electrons in the detector 12 is set at START to begin the time count in the time interval mesurement device 13. The same signal in the pulse voltage unit 14 generates a signal which is fed to the energy filter 15 and blocks it against ion ingress.

The ion that has generated the first group of secondary electrons is reflected in the field of the reflector 9 (within the zone 9), hits against the surface of the electrode 3 having a coating with a high coefficient of secondary electron emission or passes through the carbon foil once more to generate a second group of secondary electrons (the trajectory of the second group of electrons is shown with a line 27 in FIG. 1), which enter the reflector 5 and then pass to the detector 12, form a STOP signal in the unit 13 used to stop the time count. The same signal removes the blocking voltage from the energy filter 15.

Given the time between the two pulses and bearing in mind that the time of emergence of the secondary electron does not exceed $10^{-12}$ to $10^{-14}$ s, one can find the ion residence time within the reflector zone (in the time-of-flight space) with high accuracy. Given the initial energy $E_o$ of the ion corresponding to the accelerating voltage $V_o$ and the ion residence time in the reflector 5, the ion mass may be unambiguously determined.

The path of movement of an ion within the reflector 5 before reflection may be conventionally divided into two zones 8 and 9. Within the first zone 8, defined by the electrodes 3 and 6, the ion loses a small part of its energy and this zone 8 is similar to a drift region in a mass-reflectron. Further, within the second zone 9, the ion, having passed by the electrode 6, gets into a high-steepness electric field where it losses all its energy and is reflected. This zone 9 corresponds to the reflector proper of a mass-reflectron. When an ion is reflected in the electric field of the above-described configuration, a time-space focusing of ion packets takes place and ions of one and the same mass having different initial energies $E_o$ remain within the time-of-flight space for one and the same time, and the presence of the initial spread in energy will not affect the accuracy of ion mass measurement. This facility makes it possible to improve resolution of the instrument while lowering the preacceleration voltage.

Ion diffusion in terms of the angle of deviation of the ion trajectory during the passage through the foil in this instrument does not affect resolution of the instrument. This is due to the fact that the time of flight of an ion in the time-of-flight space does not depend on the angle of deviation of its initial trajectory upon entrance into the time-of-flight space, so that at this point it is only important to record the moment at which the reflected ion hits against the electrode 3 or the sensing member 4. For enlarging the range of angular deviations of the trajectory at which the reflected ion still reaches the electrode 3, the geometry of the instrument is chosen in an appropriate manner. For example, with a small inlet orifice which is generally limited by the diameter of a carbon foil, the inside diameter of the grid electrodes 6,7 and of the grid 10 should be as long as posible and the height h of the time-of-flight space should be as short as possible. The latter determines the breakthrough voltage between the grid electrodes 6 and 7.

In using the time-of-flight ion mass analyzer, according to the invention, for studying plasma which is a source of UV radiation, the foil 11 is used as a screen shielding the detector 12 from spurious exposure. Since an electron emitted off from the sensing member 4 has an energy of about 10 keV, it is capable of breaking through the protective foil 11, which is up to about 1 $\mu$m thick (10,000 Å), i.e. the foil 11 is not a barrier for an electron moving toward the detector 12. The foil 11 of such a thickness is, at the same time, quite sufficient for reliable protection of the detector 12 against spurious exposure. Further, foil 11 prevents penetration of neutral atoms and negative ions onto the detector 12.

In order to prevent the instrument from misactuation in case an ion reaches the grid electrode 6 with the formation of a secondary electron, there is provided the analyzing grid 10 upstresm from the detector 12 which functions as an energy filter with a potential barrier which passes to the detector 12 only those electrons which have the energy corresponding to the full potential difference between the foil (sensing member 4) and the bottom electrodes 7, i.e. $V_o$. Such a filter being provided, spurious secondary electrons generated upon interaction of an ion with the intermediate grid electrode 6 will have an energy which is 10% lower than that of the useful secondary electrons (at $V \approx 10$ kV, $\Delta V$ is about 1 kV).

In the embodiment of the time-of-flight ion mass analyzer shown in FIG. 3 the electrode 6' is under the same potential $V_I$ as the electrode 6 and the electrode 19 is under the potential $V_o$ as well as the electrode 3. Contrasted to the instrument shown in FIG. 1, in this case an ion from the preacceleration channel 17 enters the deceleration zone 9' at an angle $\alpha$ with respect to the planes of the electrodes 6 and 7 defining this zone, and the reflected ion is let out from the deceleration zone 9' at the same angle $\alpha$, enters the ion outlet passage 18 and is recorded by the auxiliary detector 20 (the trajectory of the ion movement in the instrument is conventionally shown with a line 28). This arrangement excludes the possibility of the reflected ion from entering the reacceleration device 1 and then back to the time-of-flight space.

When a louver is used as the sensing member 4 of the analyzer detecting the moment at which an ion enters the time-of-flight space, the ion flow 22 (FIG. 4) reaches the surface of the fins 21 at a gliding angle $\beta$ of about 5°. In this case the secondary electron emission is about five times as great as for a beam incident at right angles to the surface. This is associated with the reduced thickness of a layer which an electron should overcome so as to emerge from the substance with the gliding incidence of an ion.

At the same time, comparatively large energy losses and angular deviations of ion trajectories upon their entrance to the time-of-flight space in case an ion flow being studied is incident at a gliding angle does not have any practical influence on high resolution of the instrument as mentioned above.

When a multichannel plate is used as the sensing member 4 (FIG. 5), the same advantages are obtained as those referred to in the description of the louver embodiment. It should be noted that the choice of the ratio of the plate thickness H to the diameter d of the channels 23 should be a maximum of 10–15 with an angle of inclination of the channels 23 to the plate bases $24 \leqq 10°$. These dimensions make it possible to prevent eventual reincidence of an ion upon the wall of the channel 23 during its movement through the channel 23.

We claim:

1. A time-of-flight ion mass analyzer comprising:

(a) a casing;

(b) a device for preaccelerating ions being analyzed, located in said casing of the time-of-flight ion mass analyzer;

(c) sensing member means of the ion mass analyzer for detecting a moment at which an ion enters a time-of-flight space, said sensing member means being located downstream from said preacceleration device in said casing of the ion mass analyzer and in a path of movement of said ions;

(d) a reflector positioned downstream from said sensing member means in said casing of the ion mass analyzer and having at least two grid electrodes, a first intermediate grid electrode located downstream from said sensing member means, and receiving a voltage potential from a voltage source, and forming at least two zones in said reflector, a first zone having a different electrical field potential gradient relative to an electrical field potential gradient of a second zone, and a second bottom grid electrode positioned downstream from said first intermediate grid electrode in the ion mass analyzer and receiving a voltage potential from said voltage source and providing a potential difference between said bottom grid electrode and said sensing member means, said potential difference being defined as an absolute value which is at least equal to, a potential difference at said preacceleration device;

(e) an electron detector located downstream from said casing of the reflector in the ion mass analyzer; and (f) a time interval measurement device located downstream from said electron detector outside said casing of the ion mass analyzer and having an input connected to an output of said electron detector.

2. A time-of-flight ion mass analyzer according to claim 1, wherein said ion mass analyzer further comprises an energy filter positioned above an inlet of said preacceleration device, said inlet located between said energy filter and said intermediate grid electrode, and said energy filter having an input electrically connected to said output of said time interval measurement device.

3. A time-of-flight ion mass analyzer according to claim 1, wherein said sensing member comprises a louver having fins, said fins positioned relative to said path of movement of said ions through said time-of-flight ion mass analyzer and said fins positioned at an angle not exceeding ten degrees (10°) and a width of said fins sufficiently wide to prevent incident ion flow from entering said ion mass analyzer.

4. A time-of-flight ion mass analyzer according to claim 1, wherein said sensing member of said analyzer comprises a microchannel plate having a plurality of inclined channels, each of said inclined channels having an angle of inclination not exceeding ten degrees (10°) relative to a base of said microchannel plate and a width sufficiently wide to prevent incident ion flow.

5. A time-of-flight ion mass analyzer according to claim 1, wherein said first intermediate grid electrode is positioned behind said sensing member in the analyzer at a plane extending at an angle relative to said path of movement of said ions; said reflector comprises said first zone being in a form of at least two channels, a first channel for preliminary acceleration of electrons and a second ion outlet channel, and said channels having axes intersecting at an angle $2(\pi - \alpha)$; and an ion detector positioned near an outlet of said second ion outlet channel.

* * * * *